US008499597B2

(12) United States Patent
Bayer et al.

(10) Patent No.: US 8,499,597 B2
(45) Date of Patent: Aug. 6, 2013

(54) DEVICE AND METHOD FOR THE SURFACE PEENING OF A COMPONENT OF A GAS TURBINE

(75) Inventors: Erwin Bayer, Dachau (DE); Max Niegl, München (DE); Holger Polanetzki, Dachau (DE); Thomas Peschke, Gröbenzell (DE); Thomas Dautl, Weichs (DE); Philipp Thümmler, München (DE)

(73) Assignee: MTU Aero Engines GmbH, Munich (DE)

( * ) Notice: Subject to any disclaimer, the term of this patent is extended or adjusted under 35 U.S.C. 154(b) by 770 days.

(21) Appl. No.: 12/519,029

(22) PCT Filed: Dec. 5, 2007

(86) PCT No.: PCT/DE2007/002198

§ 371 (c)(1),
(2), (4) Date: Oct. 22, 2009

(87) PCT Pub. No.: WO2008/071164

PCT Pub. Date: Jun. 19, 2008

(65) Prior Publication Data

US 2010/0043512 A1 Feb. 25, 2010

(30) Foreign Application Priority Data

Dec. 13, 2006 (DE) ..... 10 2006 058 675

(51) Int. Cl.
*C21D 7/06* (2006.01)
*B24B 39/00* (2006.01)

(52) U.S. Cl.
USPC ..... 72/53; 29/90.7; 72/710

(58) Field of Classification Search
USPC ..... 72/53, 710; 29/90.7
See application file for complete search history.

(56) References Cited

U.S. PATENT DOCUMENTS

| | | | | |
|---|---|---|---|---|
| 3,482,423 | A * | 12/1969 | Smith et al. | 72/53 |
| 6,336,844 | B1 | 1/2002 | Duquenne et al. | |
| 6,490,899 | B2 * | 12/2002 | Berthelet et al. | 72/53 |
| 6,508,093 | B2 * | 1/2003 | Berthelet et al. | 72/53 |
| 6,514,039 | B1 * | 2/2003 | Hand | 415/119 |
| 7,028,378 | B2 * | 4/2006 | Cheppe et al. | 29/90.7 |
| 7,389,663 | B2 * | 6/2008 | Cheppe et al. | 72/53 |
| 8,091,192 | B2 * | 1/2012 | Bayer et al. | 29/90.7 |
| 2003/0115922 | A1 | 6/2003 | Berthelet et al. | |
| 2006/0174483 | A1 | 8/2006 | Bayer et al. | |
| 2009/0288463 | A1 * | 11/2009 | Cheppe et al. | 72/53 |

FOREIGN PATENT DOCUMENTS

FR 2 815 280 4/2002

* cited by examiner

*Primary Examiner* — Edward Tolan
(74) *Attorney, Agent, or Firm* — Greer, Burns & Crain, Ltd.

(57) ABSTRACT

A device for surface peening, in particular for ultrasonic shot peening, of a component of a gas turbine, having at least one vibration device that includes a surface that impinges the blasting material, and having a holding device by which a surface area of the component can be positioned relative to the surface of the vibration device, the surface of the vibration device being subdivided into at least two adjacent partial surfaces, each including an overlapping part by which a part of the surface area of the component can be treated by blasting material impinged both by the one and by the other partial surface.

13 Claims, 3 Drawing Sheets

DEVICE AND METHOD FOR THE SURFACE PEENING OF A COMPONENT OF A GAS TURBINE

BACKGROUND

The present invention relates to a device and to a method for the surface peening, in particular ultrasonic shot peening, of a component of a gas turbine of the type indicated in the preambles of patent claims 1 and 12.

Such a device and such a method are already known from EP 1 101 568 B1, in which the rotor blades of a rotor fashioned as a blisk can be shot-peened in order to improve fatigue strength. The device comprises a holding device with which the rotor is mounted so as to be capable of rotation about its axis of rotation. Through the rotation of the rotor, its rotor blades are guided through a peening chamber on the lower side of which is fastened a vibration device in the form of an ultrasonic sonotrode having a surface that runs at least approximately horizontally and that impinges or accelerates the blasting material. The peening chamber is thus bounded both axially, i.e. in the area of the broad sides of the rotor, and also radially, i.e. in the area of the rotor blades, relative to the blisk by corresponding chamber walls. Because in particular the chamber walls of the peening chamber that are positioned radially to the rotor are not able, depending on the position of the respective rotor blades, to hold all the shot inside the central peening chamber, two additional chambers are situated before and after this chamber, in the radial direction of the rotor. Inside these additional chambers, shot spilling out from the central peening chamber, which is equipped with the sonotrode, is collected and led back via corresponding channels.

However, a problem with this device and this method is the fact that components having complex shapes are difficult to strengthen in a uniform manner. This is true in particular for surface areas of the component that are not positioned parallel to the vibrating surface of the vibration device, or that are moved into such a position.

SUMMARY

Therefore, the object of the present invention is to create a device and a method of the type named above with which the surface area of the component that is to be treated can be peened or strengthened as uniformly as possible.

In order to achieve a maximally homogenous and uniform strengthening of the overall surface area of the component that is to be peened, in the device according to the present invention it is provided to fashion the surface of the vibration device so that it is subdivided into at least two adjacent partial surfaces, each comprising an overlapping part by means of which a part of the surface area of the component that is to be treated is capable of being treated by blasting material impinged both by the one and by the other partial surface. In the method according to the present invention, it is provided to treat the corresponding part of the surface area of the component that is to be treated successively with the blasting material impinged by each of the overlapping parts.

In other words, according to the present invention instead of one vibrating surface at least two adjacent vibrating partial surfaces are provided, making it possible to carry out a more individual adaptation to the particular partial areas of the surface of the component. Such an adaptation may for example mean that the two surfaces are positioned at different angles, or that they impinge different blasting material, or a different quantity of blasting material. Thus, individual partial areas of the overall surface of the component that is to be peened can be peened in a more individual fashion in order to achieve the desired maximally homogenous strengthening.

However, so that the area between the two partial surfaces can also be strengthened equally well, each of the partial surfaces has an overlapping part, each of which can accelerate respective blasting material in the direction of this part of the surface area that is to be treated. In other words, the two overlapping parts enable a homogenous and good strengthening, even in the intermediate area between the two partial surfaces, of the part situated in this area of the treatable surface area of the component.

Thus, overall it can be seen that the possibility is created of using two individually adaptable partial surfaces, the two overlapping parts nonetheless ensuring that even between the two partial surfaces a very good strengthening can be carried out of the part situated there of the surface area of the component to be treated.

In a simple specific embodiment of the present invention, the two adjacent partial surfaces can lie in the same plane. This is possible in particular if the surface area of the component that is to be peened is not very complex. If the two partial surfaces lie in the same plane, it is also conceivable for them to be allocated to the same vibration device.

If, in contrast, a surface area of the component is to be peened having greater complexity, in a further embodiment of the present invention it has turned out to be particularly advantageous if the two partial surfaces are situated at an angle to one another, so that the two partial surfaces can be adapted optimally to the respective part that is to be peened of the surface area being treated.

Preferably, a separate peening chamber is allocated to each of the two adjacent partial surfaces, so that a division takes place into at least two sub-chambers in which a constant quantity of blasting material is always present, so that in this way a uniform peening result can be realized.

In addition, it is then possible to realize a transition-free peening between the two partial surfaces impinged using the different vibration devices. Moreover, due to the two partial surfaces situated inside the respective peening chambers, a synchronous peening on both sides of thin-walled components is possible without the possibility of an unpeened or insufficiently peened area in the border area of the two chambers. The synchronous peening of the thin-walled components ensures in particular that these components are not unintentionally deformed.

Here, the separation between the two partial surfaces is realized in particularly simple fashion by a dividing wall whose cross-section can be for example S-shaped. Of course, it would also be conceivable to fashion the dividing wall as a planar wall, which would then however have to run obliquely in such a way that the blasting material impinged by the two overlapping areas can each reach that part of the surface area of the component to be treated that is situated between the two partial surfaces.

It has also turned out to be advantageous if chamber walls of the peening chamber are formed in some areas by sliding walls. Such sliding walls have in particular the advantage that after the positioning of the component inside the device, they can be moved toward the component in such a way that blasting material cannot exit from the peening chambers.

In addition, it has turned out that the device according to the present invention can be used in particular for surface peening of rotors fashioned as blisks, because such blisks often have a relatively complex surface geometry. Accordingly, with the device according to the present invention it is possible to strengthen the complex surface geometry in as homogenous a manner as possible.

It is also turned out to be advantageous if the rotor is capable of rotation about its axis of rotation, so that the part of the surface area of the rotor that is to be treated can be impinged successively by blasting material accelerated both by the one and by the other partial surface.

In particular if an obliquely oriented surface of the at least one vibration device is used, it has turned out to be advantageous if a distribution device is provided by which the blasting material that collects at the lowest point of the surface can be distributed uniformly over this surface.

The advantages of the device according to the present invention are also to be regarded as advantages of the method according to the present invention. In particular, in the method according to the present invention it would also be conceivable for the at least two partial surfaces to be oriented relative to the surface area to be treated of the component or of the rotor.

BRIEF DESCRIPTION OF THE DRAWINGS

Further advantages, features, and details of the present invention result from the following description of a preferred exemplary embodiment, and from the drawings.

DETAILED DESCRIPTION

Figure 1:
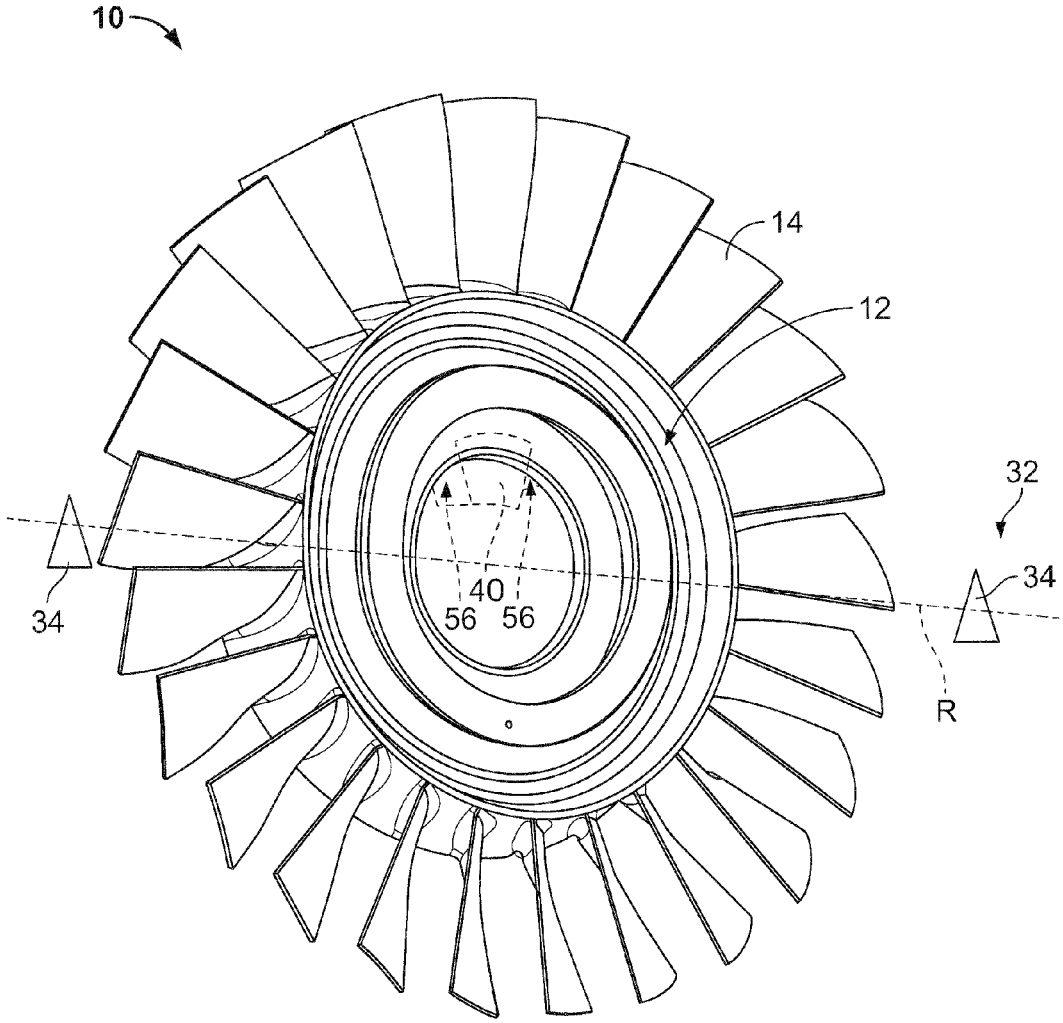
FIG. 1 shows a schematic perspective view of a rotor that is fashioned as a blisk and is capable of rotation about an axis of rotation, on whose disk a device for surface peening is shown in broken lines.
Figure 2:
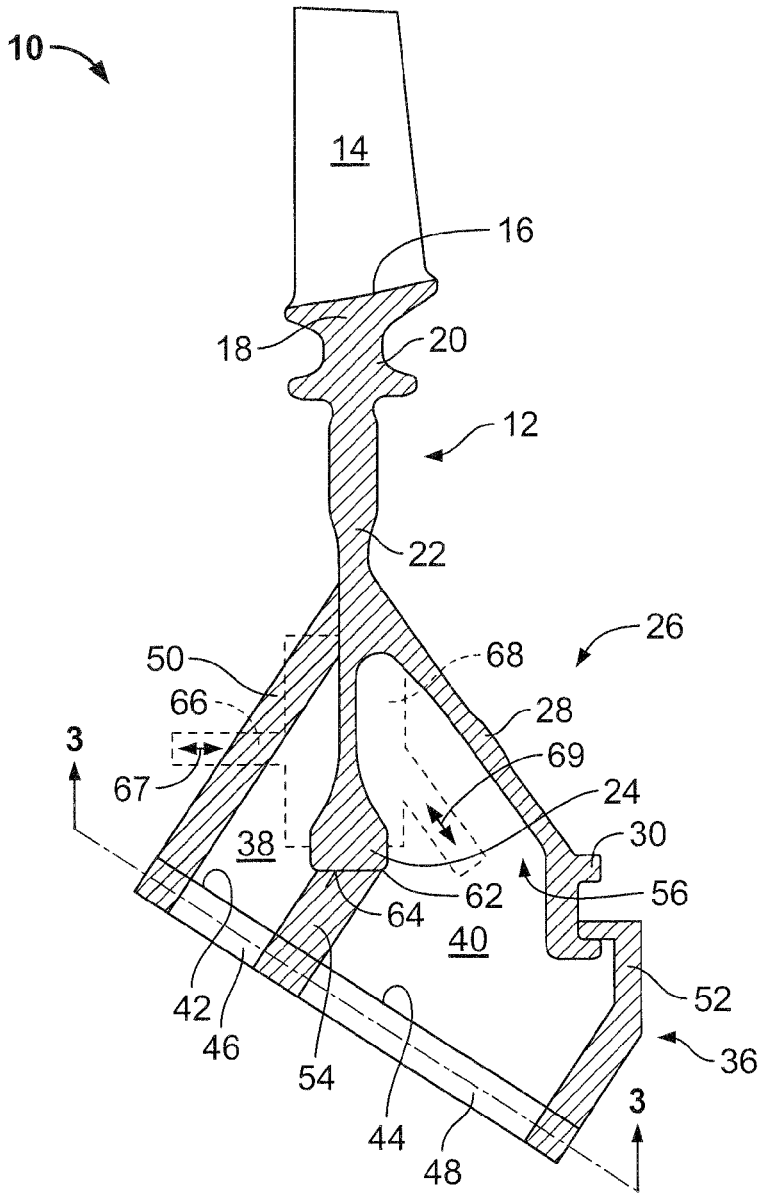
FIG. 2 shows a schematic sectional view through the rotor according to FIG. 1, making visible the device for surface peening of the disk, comprising two partial surfaces, to each of which a separate peening chamber is allocated.

In FIG. 1, in a schematic perspective view a rotatable rotor of a gas turbine, in the form of a blisk 10, can be seen schematically. Together with FIG. 2, which shows blisk 10 in a schematic sectional view, the basic individual areas of the blisk can be seen in more detail. In particular, a blisk disk 12 is visible on whose outer circumference a large number of rotor blades 14 are situated. Of blisk disk 12, essentially a peripheral blade shape 16 can be seen that in FIG. 2 is shown as a line, to which a lower blade shape area 18 is connected radially inwardly (or, in the drawing, radially downwardly). Lower blade shape area 18 goes radially inwardly over into a disk throat 20 that connects the lower blade shape area to a disk element 22. The radially inner end of disk element 22 is formed by a hub 24 that represents a counterweight to rotor blades 14. At the right side (in the drawing) of blisk disk 12, from disk element 22 a wing 26 projects that comprises a web 28 and an essentially U-shaped area 30. Overall, blisk 10 is fashioned rotatably, i.e. rotationally symmetrically, about an axis of rotation R.

Of a device for shot peening a lower area of blisk disk 12, in FIG. 1 a holding device 32 is represented by two symbolically indicated bearing brackets 34 via which blisk 10 is held or mounted so as to be capable of rotation about its axis of rotation R. In addition, in FIG. 1 a peening chamber arrangement 36 is shown in broken lines, visible in more detail in combination with FIG. 2. Peening chamber 36 comprises in the present case two peening chambers 38, 40 (described in more detail below) that are separated from one another, to each of which in the present case there is allocated a partial surface 42, 44, which impinges the respective blasting material, of a respective vibration device 46, 48. In the present case, vibration devices 46, 48 are fashioned as ultrasonic sonotrodes with which a blasting material placed in the respective peening chamber 38, 40, for example in the form of shot, can be accelerated. Accordingly, in the present case a radially inner surface area of blisk disk 12 can be shot-peened, said area extending (as seen in FIG. 2) from the left side of disk element 22 to U-shaped area 30 of wing 26. This surface area can be treated, i.e. strengthened, rotationally around blisk disk 12 by rotating blisk 10, mounted on holding device 32, about its axis of rotation R. Accordingly, by means of holding device 32 blisk 10 is situated or positioned relative to vibrating partial surfaces 42, 44 of the respective vibration device 46, 48.

Of the two peening chambers 38, 40, the outer radial chamber walls 50, 52 can be seen, as can a center dividing wall 54 that is explained in more detail below. Chamber walls are also provided on the radial end faces 56 of peening chambers 38, 40. Here, chamber walls 50, 52 can be fashioned flexibly, or can be provided with seals (not shown), so that no blasting material can exit between them and blisk disk 12. However, chamber walls 50, 52 are at least brought close enough to blisk disk 12 that in any case a gap results that is significantly smaller than the diameter of the blasting material used.

Figure 3:
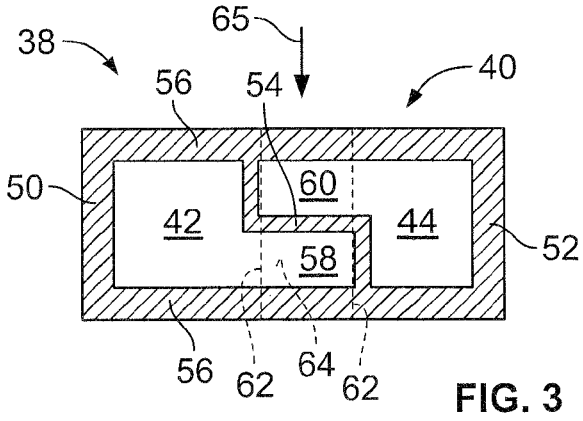
FIG. 3 shows a schematic sectional view through the two partial surfaces of respectively associated vibration devices, and through the associated two peening chambers, divided from one another by an S-shaped dividing wall along the line III-III in FIG. 2.

Regarded together with FIG. 3, which shows the two peening chambers 38, 40, i.e. the surfaces 42, 44 of the associated vibrating devices 46, 48 situated inside these chambers, along line III-III in FIG. 2, it will be seen that the two partial surfaces 42, 44 forming the overall oscillating surface, or the surface that impinges the respective blasting material, comprise in each case an overlapping part 58, 60 that is subdivided in the area of dividing wall 54. In particular, in FIG. 3 it can also be seen that a part 64, represented by the two broken lines 62 (in the present case, this part is the end face of hub 24) of the surface area of blisk disk 12, is situated above both overlapping parts 58, 60 when blisk 10 is correspondingly rotated about its axis of rotation R. In other words, in this way part 64 of the surface area comes both within the one peening chamber 38 and the other peening chamber 40, in each of which the associated blasting material is accelerated by the respective partial surface 42, 44. In FIG. 3, the direction of rotation of blisk 10 is indicated by arrow 65. Accordingly, part 64 of the surface area of blisk disk 12 first passes through peening chamber 38 and then passes through peening chamber 40, so that part 64 is successively impinged by blasting material accelerated by each of the partial surfaces 42, 44. Instead of the rotational movement of component 10 provided here, in particular in the case of components that are not rotationally symmetrical it would of course also be conceivable to move the component in a linear path relative to partial surfaces 42, 44.

Through the positioning of the two overlapping parts 58, it is possible on the one hand to use separate peening chambers 38, 40 in order for example to position partial surfaces 42, 44 at an angle to one another, or to introduce a suitable quantity of blasting material, or to exert a corresponding peening intensity against the partial surfaces to be treated. In addition, such a positioning of two peening chambers 38, 40 enables a synchronous treatment of components—in the present case, for example disk element 22. In addition, overlapping parts 58, 60 ensure that center part 64 is also impinged equally well with blasting material.

In the present exemplary embodiment, separating wall 54 is S-shaped. However, it would also be conceivable to use a separating wall 54 that extends in planar fashion between the two radial end faces 56.

In order also to enable a tight sealing, with the two peening chambers 38, 40, of an undercutting contour (such as in the area of disk element 22, or its hub 24, in the present case) against the exiting of blasting material, in the present exemplary embodiment the chamber walls on end face 56 are formed in some areas by sliding walls 66, 68 that can be moved in the direction of arrows 67, 69. This makes it possible to situate the two peening chambers 38, 40 essentially tightly against blisk disk 12. It is also to be regarded as comprised within the scope of the present invention that such sliding walls 66, 68 could also be used to tightly divide the two peening chambers 38, 40 from one another in the area of dividing wall 54. Through this division into the two peening chambers 38, 40, despite disturbing contours a uniform peening result can nonetheless be achieved, so that despite the interleaved separating walls 52 no shift in the number of shot, i.e. quantity of blasting material, occurs in the two different peening areas, which would result in differing intensities of the strengthening.

In the present exemplary embodiment, both partial surfaces 42, 44 lie in the same plane. In this way, it is also conceivable to operate the two surfaces 42, 44 using a common vibration device 46 or 48.

Figure 4:
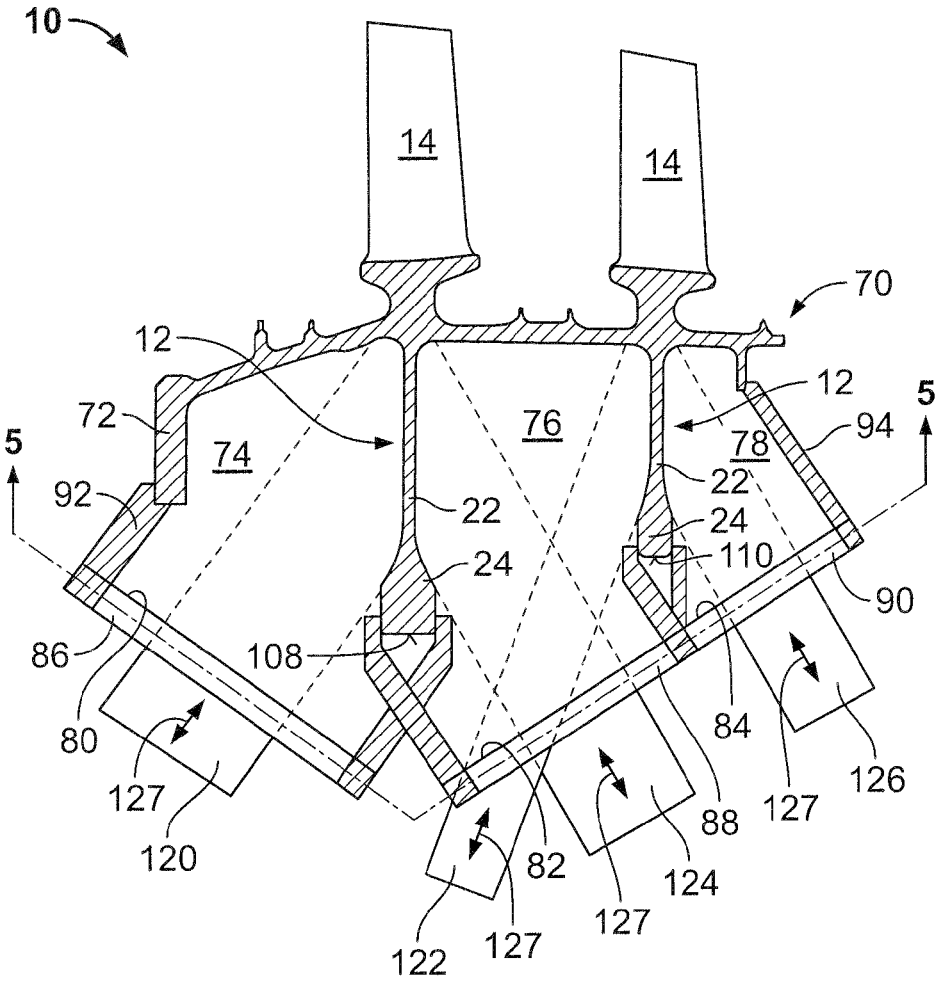
FIG. 4 shows an alternative specific embodiment of the device for surface peening with which the disk area of a blisk having multiple stages can be peened.
Figure 5:
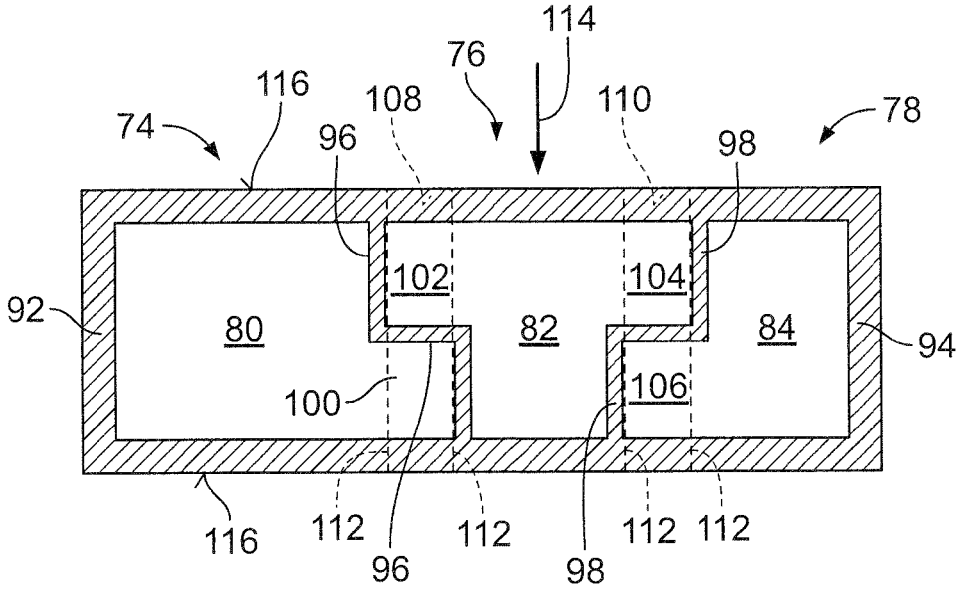
FIG. 5 shows a schematic sectional view along the line V-V in FIG. 4, in which three partial surfaces of respective vibration devices can be seen, divided by respective S-shaped dividing walls of respective peening chambers.

Finally, a combined view of FIGS. 4 and 5 shows an alternative specific embodiment of the device for surface peening. Here, FIG. 4 shows a blisk 10 that has two stages, accordingly comprising two blisk disks 12, to each of which is allocated an outer surrounding peripheral arrangement of associated rotating blades 14. Toward one side, blisk 10 ends at a radially peripheral wing 70, and at the other side it ends at a radially peripheral flange 72. Between wing 70 and flange 72, three peening chambers 74, 76, 78 are provided, each peening chamber 74, 76, 78 being provided with a vibration device 86, 88, 90 that has a partial surface 80, 82, 84. From FIG. 4, it can be seen that partial surface 80 is positioned at an angle or V-shape relative to the two other partial surfaces 82, 84. In contrast, the two partial surfaces 82, 84 are situated in a plane. The two outer peening chambers 74, 78 comprise outer chamber walls 92, 94 that terminate peening chambers 74, 78 relative to flange 72 or to wing 70. Toward the respectively adjacent peening chamber 74, 76, 78, two separating walls 96, 98 are provided that in the present case, differing from the embodiment according to FIG. 2, are not connected at their end face to the associated hub 24, but rather are connected axially externally.

Regarded together with FIG. 5, which schematically shows the peening chambers 74, 76, 78, or the partial surfaces 80, 82, 84 situated in this area, along the line V-V in FIG. 4, it will be seen that the two separating walls 96, 98 are again essentially S-shaped. Center peening chamber 76, or center partial surface 82, is accordingly laterally bounded by the two separating walls 96, 98.

S-shaped separating walls 96, 98 again form overlapping parts 100, 102, 104, 106 of partial surfaces 80, 82, 84, through which a part 108, 110 of the surface area to be treated of blisk disk 12—in the present case, again the respective end face of the respective hub 24—can be impinged by blasting material accelerated both by the one and by the other partial surface 80, 82, 84. Parts 108, 110 are indicated in FIG. 5 by broken lines 112. The distinguishing characteristic of the present exemplary embodiment is that center partial surface 82 has two overlapping parts 102, 104, that are positioned, with the respectively corresponding overlapping parts 100, 106, in the area of the respective part 108, 110 of blisk disk 12 that is to be treated. Overall, however, in this arrangement as well it is again achieved that individually adjustable conditions prevail inside the three peening chambers 74, 76, 78, so that as a whole blisk disk 12 can be peened extremely homogenously and in accord with the needs of the situation. In order to enable achievement of an equally good strengthening of the surface in the area of the two hubs 24, or in the area of parts 108, 110 at which the division of peening chambers 74, 76, 78 takes place, the respective separating walls 96, 98 are again fashioned in S-shaped stepped form, so that as blisk 10 executes the rotation indicated by arrow 114, parts 108, 110 of the respective hub 24 are situated above both the one and the other overlapping part 100, 102, 104, 106, and are correspondingly impinged by blasting material from the various peening chambers 74, 76, 78. In other words, during a rotation of the blisk in the direction of arrow 114, part 108, 110 of the surface area of blisk disk 12 passes first through peening chamber 82 and then through peening chamber 80 or 84, so that the respective part 108, 110 is impinged successively by blasting material accelerated both by the one and by the other partial surface 82 and 80 or 84.

On one end face 116 of peening chambers 74, 76, 78, a plurality of sliding walls 120, 122, 124, 126 is again provided with which the undercutting contour of the two sliding elements 22, or of hub 24, can be closed, so that no blasting material can escape from the respective peening chamber 74, 76, 78. For this purpose, sliding walls 120, 122, 124, 126 can be moved along arrows 127. In the present case, partial surfaces 42, 44, or 80, 82, 84, each run obliquely to a line perpendicular to axis of rotation R. However, it is also to be regarded as comprised within the scope of the present invention that partial surfaces 42, 44, or 80, 82, 84, may also run parallel to axis of rotation R, or perpendicular to a line perpendicular to axis of rotation R.

What is claimed is:

1. A device for surface peening, in particular for ultrasonic shot peening, of a component of a gas turbine, the device comprising:

at least one vibration device including a surface that impinges the blasting material and a chamber having a dividing wall extending across the chamber that subdivides the chamber into separate peening chambers; and a holding device by means of which a surface area of the component can be positioned relative to the surface of the vibration device, the surface of the vibration device being subdivided into at least two adjacent partial surfaces, each of said partial surfaces being associated with a separate one of said peening chambers, and an overlapping part by means of which a part of the surface area of the component can be treated by blasting material impinged by each partial surface.

2. The device as recited in claim 1, characterized in that the two adjacent partial surfaces lie in a common plane.

3. The device as recited in claim 1, characterized in that the two adjacent partial surfaces are situated at an angle to one another.

4. The device as recited in claim 1, characterized in that a separate vibration device is allocated to each of the two adjacent partial surfaces.

5. The device as recited in claim 1, characterized in that a said dividing wall is situated between the two adjacent partial surfaces.

6. The device as recited in claim 5, characterized in that the said dividing wall is fashioned with a cross-section that is essentially S-shaped.

7. The device as recited in claim 1, characterized in that chamber walls of the peening chambers are formed in some areas by sliding walls.

8. The device as recited in claim 1, characterized in that a rotor, in particular a blisk, is allocated to the surface area of the component.

9. The device as recited in claim 1, characterized in that the component is capable of rotation about its axis of rotation, as a result of which the part of the surface area of the rotor is capable of being treated successively by blasting material impinged both by the one and by the other partial surface.

10. A method for surface peening, in particular for ultrasonic shot peening, of a component of a gas turbine, in which a surface area of the component and a surface of a vibration device that impinges the blasting material are situated relative to one another and are moved relative to one another during the surface peening, comprising:

providing a chamber including a dividing wall extending across the chamber wherein the dividing wall subdivides the chamber into separate peening chambers; and peening a part of the surface area of the component by blasting material impinged by respective overlapping parts of at least two adjacent, partial surfaces of the surface of the vibration device, wherein each of the partial surfaces is associated with a one of the separate peening chambers.

11. The method as recited in claim 10, characterized in that the part of the surface area of the component is moved through peening chambers allocated to the respective partial surfaces.

12. The method as recited in claim 10, characterized in that the component for surface peening of the part of the surface area of the component is rotated about an axis of rotation.

13. The method as recited in one claim 10, characterized in that the surface area of the component is positioned relative to the two partial surfaces by means of a holding device.

* * * * *